US005623772A

United States Patent [19]

Sunderland et al.

[11] Patent Number: 5,623,772

[45] Date of Patent: Apr. 29, 1997

[54] FOOT-WARMING SYSTEM FOR A BOOT

[75] Inventors: Michael E. Sunderland; Douglas R. Clark, both of Eugene, Oreg.

[73] Assignee: Ski-Time Corporation, Eugene, Oreg.

[21] Appl. No.: 621,201

[22] Filed: Mar. 21, 1996

Related U.S. Application Data

[63] Continuation of Ser. No. 373,956, Jan. 17, 1995, abandoned.

[51] Int. Cl.[6] ..... A43B 7/02

[52] U.S. Cl. ..... 36/2.6; 36/136; 219/211

[58] Field of Search ..... 36/1, 2.6, 10, 136, 36/55, 132, 139, 50.1, 51; 12/142 P; 126/204; 219/211, 527, 528, 549; 607/108–112

[56] References Cited

U.S. PATENT DOCUMENTS

| | | | |
|---|---|---|---|
| D. 346,063 | 4/1994 | Clark et al. . | |
| 3,613,271 | 10/1971 | Geller | 12/142 P |
| 3,663,796 | 5/1972 | Hines et al. . | |
| 3,906,185 | 9/1975 | Gross et al. . | |
| 3,946,193 | 3/1976 | Giese . | |
| 4,080,971 | 3/1978 | Leeper . | |
| 4,280,287 | 7/1981 | Gulbransen | 36/136 |
| 4,296,559 | 10/1981 | Gamm | 36/136 |
| 4,780,968 | 11/1988 | Bragagnolo . | |
| 4,910,881 | 3/1990 | Baggio et al. . | |
| 4,950,858 | 8/1990 | Slenker . | |
| 5,051,095 | 9/1991 | Slenker . | |
| 5,063,690 | 11/1991 | Slenker . | |

*Primary Examiner*—M. D. Patterson

*Attorney, Agent, or Firm*—Chernoff, Vilhauer, McClung & Stenzel LLP

[57] ABSTRACT

An exemplary foot-warming system includes a device wherein a support assembly detachably mounts a battery pack on the upper surface of a boot to electrically power a heating element within the boot via an electrical cord that preferably passes through an opening in the boot beneath the mounted battery pack. The support assembly preferably includes a shallow retaining barrier, such as a frame-shaped sheet, for normally confining the battery pack to a predetermined position on the boot and a stretchable outer covering, such as an elastomeric panel, that forms a yieldable pocket within the barrier so that during a strong jolt to the battery pack or boot, the pocket can stretch to allow movement of the battery pack for reducing the level of shock forces transmitted and further can contract, after impact, to return the battery pack to its predetermined position. When the battery pack is removed, preferably the end connector on the cord is passed back through the opening in the boot to a nonexposed position either inside or outside of the boot.

10 Claims, 3 Drawing Sheets

FOOT-WARMING SYSTEM FOR A BOOT

This application is a continuation of application Ser. No. 08/373,956, filed Jan. 17, 1995, now abandoned.

BACKGROUND OF THE INVENTION

The present invention relates to foot-warming systems for boots and, in particular, relates to the use of those types of foot-warming devices in which portions of the device are selectively removable from the boot so as to lighten the weight of the boot when the device is not in use.

In accordance with conventional technology, there are primarily two types of foot-warming devices used in connection with boots. The first type of device is fully integrated on the boot and may include, for example, a battery charger within the heel of the boot which connects, via a power cord, to a heating element located inside the boot. One conventional type of heating element comprises a flat pad which is mounted to lie along the insole of the boot and which includes a serpentine conductor that is sandwiched between flexible plastic layers. With respect to this type of element, an example of which is shown in Baggio et al. U.S. Pat. No. 4,910,881, heat is generated by passing current through the serpentine conductor.

When a foot-warming device is fully integrated on the boot, as in the manner just described, if damage occurs to the device, such as due to shock caused by jarring of the boot, typically the damage cannot be repaired without disassembling the boot, thereby making repair of this type of device prohibitively expensive. Furthermore, the different components of such a device contribute to the total weight of the boot even when the device does not need to be in operation on the boot, such as during the warmer seasons of the year. In order to address this problem of excess weight, it is possible to purchase separate boots for warm- and cold-season usage, but this option is too expensive except for a small minority of users.

To overcome the difficulties just described, foot-warming devices have been developed in which those components most likely to require attention are detachably mounted on the boot. In these devices, typically the battery pack which is used to energize the heating element and sometimes the heating element itself can be completely removed from the boot thereby enabling these primary components to be maintained or stored separately from the boot. In one typical construction, the battery pack is fastened to the exterior of the boot either by a clip that fits over the collar of the boot or by a belt that fastens around the boot neck. With either of these two securement methods, however, there is a tendency for the battery pack to shift its position and to work loose from the boot, so that in order to keep the battery pack on the boot, constant readjustment of the position of the battery pack is required.

With particular regard to those types of boots where the upper portion of the boot is made of a thick and rigid material, such as the molded plastic compound frequently used for ski-boots, an alternative method of securing the battery pack to the boot uses a cavity formed in the rigid upper portion of the boot. The sides of this cavity serve to hold the battery pack in a predetermined position on the boot, thereby eliminating the need for constant readjustment of the battery pack's position. This type of securement method is shown, for example, in Bragagnolo U.S. Pat. No. 4,780,968. However, this method has been regarded as having limited applicability, and an alternative securement method has been sought which can be used not just with boots having rigid and thick uppers but with other types of boots as well, including those having uppers made with thinner layers of nonrigid or semipliable material, such as leather or rubber sheeting. In other words, it is desired that the foot-warming device be adaptable to boots of a wide variety of styles in order to accommodate the widely varying preferences of different users in respect to boots.

An alternative securement method that has been used with boots having both rigid and nonrigid uppers relies on a rigid bracket that is mounted to the outer surface of the boot, which bracket forms a platform for detachably mounting the battery pack. Such a bracket is shown, for example, in Giese U.S. Pat. No. 3,946,193 and in Slenker U.S. Pat. Nos. 4,950,858 and 5,063,690. In accordance with this approach, the front face of the rigid bracket may be shaped so as to conform to a complementary surface on the back side of the battery pack and the rear face of the bracket can either be curved in order to conform to the rounded shape of the outer surface or can be provided with legs in order to space the bracket from the boot. When this type of bracket is used, however, an additional element is introduced between the battery pack and the boot's outer surface so as to cause the battery pack to jut out prominently from the boot. In this position, the battery pack can, in some instances, interfere with hiking or climbing, particularly when the user is crossing rough terrain.

With respect to those mounting structures that hold the battery pack in stationary position on the boot, such as the rigid cavity and bracket structures above described, it is known to provide one or more electrical connectors in predetermined location on such structures so that the battery pack is automatically connected to the heating element when mounted on the structure. Such connectors, however, tend to be adversely affected by the outdoor elements to which they are exposed when the battery pack is not in use. In particular, moisture, grime and even airborne elements can tarnish or gradually corrode such connectors so that, over time, these connectors become less efficient at conveying current to the heating element, thereby diminishing the capacity of the foot-warming device to deliver heat.

A further difficulty with mounting structures of the rigid cavity or bracket type above described is that a severe jolt can be delivered to the battery pack or foot if impact occurs between the battery pack and a heavy external object, such as a jutting portion on a large log or stone. In addition to possibly causing injury to the foot or leg, this type of jolt can damage the internal energy cells in the battery pack so as to cause abrupt failure of the foot-warming device. Although techniques are known for reducing the frequency of such impacts, such as mounting the battery pack along less accessible portions of the boot or providing rigid members on the boot for shielding portions of the battery pack against direct impact, these techniques may involve adding extra weight to the boot and, in any event, do not protect the battery pack against indirect shocks, such as can be transmitted through the boot itself. Furthermore, although it is possible to carry several spare battery packs and to replace damaged battery packs as the need arises, this adds significantly to the weight which the user must carry.

In accordance with the foregoing, a primary object of the present invention is to provide an improved foot-warming system for a boot.

A further object of the present invention is to provide a foot-warming device each of the components of which are able to be mounted on or within the boot in a manner that eliminates the need for repeated readjustment of the device during use.

Another object of the present invention is to provide a foot-warming device having removable portions so that the weight of the boot can be reduced when the device is not in use.

A related object of the present invention is to provide a foot-warming device in which those portions of the device most likely to need attention or repair are easily removable.

Another related object of the present invention is to provide a foot-warming device in which the battery pack of the device is able to be detachably mounted on the outer surface of the boot in such a manner as to protect the foot and battery pack against severe jolts.

Yet another related object of the present invention is to provide a foot-warming device having a removable battery pack, which pack is able to be detachably mounted on the outer surface of the boot without excessively protruding from this surface.

Still another related object of the present invention is to provide a foot-warming device for a boot most of the components of which can be removed without the use of special tools or without the removal of small and easily lost parts.

Another object of the present invention is to provide a foot-warming system in which the foot-warming device, despite use over many seasons, will retain its original heat-producing capacity.

A related object of the present invention is to provide a foot-warming system in which the conductive structures of the foot-warming device are protected against corrosion or other exposure related damage.

Another object of the present invention is to provide a foot-warming device for a boot which can be inexpensively produced so as to add relatively little to the total price of the boot.

Still another object of the present invention is to provide a foot-warming device for a boot which can be adapted for use with boots in a wide variety of styles.

SUMMARY OF THE PRESENT INVENTION

In a first aspect of a preferred embodiment of the present invention, a foot-warming device for a boot is provided, which device includes a heating element able to be positioned inside the boot, a battery pack for providing power to the heating element, and an electrical cord for detachably connecting electrically the heating element and the battery pack. In accordance with this first aspect, a support assembly for detachably supporting the battery pack is also provided, which support assembly includes an outer covering that is fastened to the boot's upper surface so as to form a pocket that opens toward the top of the boot for receiving the battery pack. This outer covering is at least partially formed of stretchable material.

In accordance with this first aspect, the removability of the battery pack from the boot makes it possible to reduce the weight of the boot when the device is not in use. Moreover, by using an outer covering to form a pocket for the battery pack and by suitably forming this pocket at least partially of stretchable material, the battery pack is able to retain its position on the upper surface of the boot without requiring repeated readjustment and, at the same time, is able to shift temporarily in response to a sudden jolt, which action reduces the peak level of shock force received by the battery pack during impact.

In a second aspect involving a preferred embodiment of the present invention, a method of using a foot-warming device is provided. In accordance with this method, a foot-warming device is used having, in combination, a heating element able to be positioned inside the boot, an electrical cord connected electrically, at one end, to the heating element and including, at the other end, a connector, a battery pack including a power terminal detachably connectable electrically to the connector and a support assembly able to detachably support the battery pack in a predetermined position along the upper surface of the boot. In accordance with the method, the connector is at least partially inserted through an opening formed in the upper surface of the boot to an exposed position suitable for connection to the power terminal, and the connector is detachably connected to the power terminal. Finally, after using said battery pack, the battery pack is removed from the support assembly and the connector is moved back through the opening to a nonexposed position removed from the opening.

In accordance with this second aspect, not only is the battery pack removed from the support assembly so as to reduce the weight of the boot, but also the connector is removed to a nonexposed position away from the opening through which it was originally inserted for connection to the battery pack. This last step protects the connector against moisture, grime or other corrosioncausing substances so that there is no gradual degradation of the electrical connection between the battery pack and the heating element. This, in turn, ensures that the heat-producing capacity of the device is maintained at a high level over the life of the device.

In a third aspect of a preferred embodiment of the present invention, a foot-warming device for a boot is provided that includes a heating element able to be positioned inside the boot, a battery pack, and an electrical cord for detachably connecting the heating element and battery pack. In accordance with this third aspect, a support assembly is also provided that is able to detachably support yieldably the battery pack along the upper surface of the boot so as to enable the battery pack to move relative to a predetermined support position fixed in relation to the boot's upper surface in response to impact between the battery pack and external objects. This support assembly includes an automatic return mechanism that, in response to any movement by the battery pack away from the predetermined support position, urges the battery pack back toward the predetermined support position.

In accordance with this third aspect, the configuration of the support assembly just described enables the battery pack to be maintained in a predetermined position on the upper surface of the boot without the need for repeated readjustment of the battery pack's position by the user. At the same time, by yieldably supporting the battery pack so as to enable the battery pack to move in response to impact with external objects, the support assembly protects the battery pack against sudden jolts that might otherwise cause sudden failure of the battery pack.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
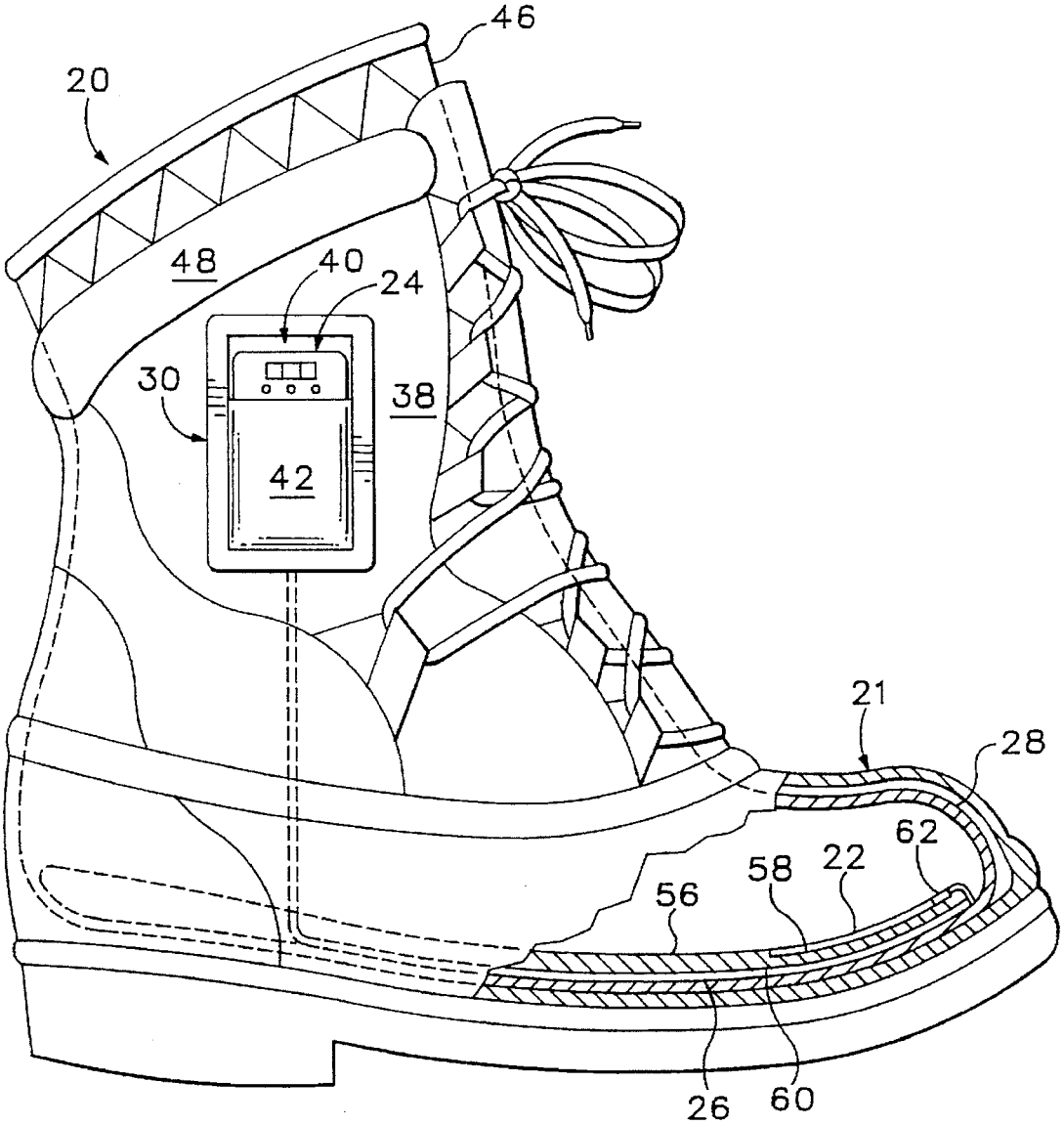
FIG. 1 is a side elevational view of an exemplary embodiment of the foot-warming device as constructed in accordance with the present invention, which device is installed on a representative boot, where portions of the boot have been cut away to show details of the device.
Figure 2:
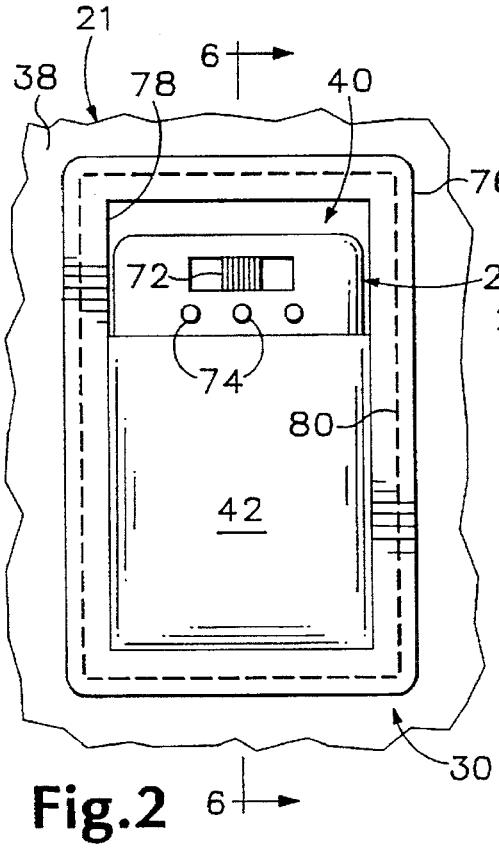
FIG. 2 is a plan view of a broken-away portion of the upper surface of the boot of FIG. 1 showing, in detail, the battery pack and support assembly of the exemplary device of FIG. 1.
Figure 4:
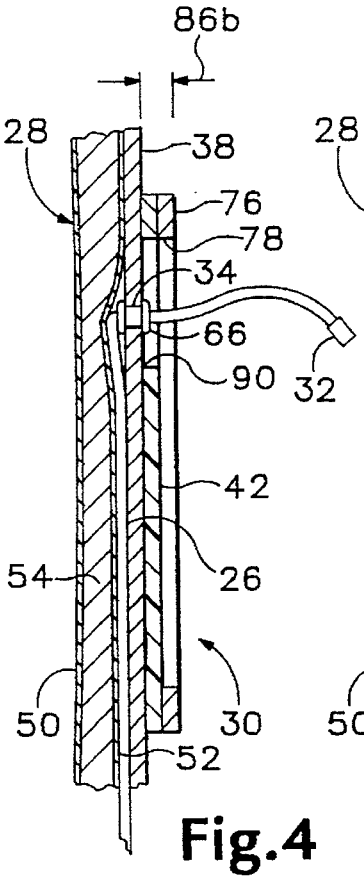
FIG. 4–6 are sectional views showing, in sequence, how the battery pack is mounted on the support assembly of the exemplary device of FIG. 1 where the last figure in the sequence, FIG. 6, corresponds to the view that is seen along lines 6—6 in FIG. 2.
Figure 5:
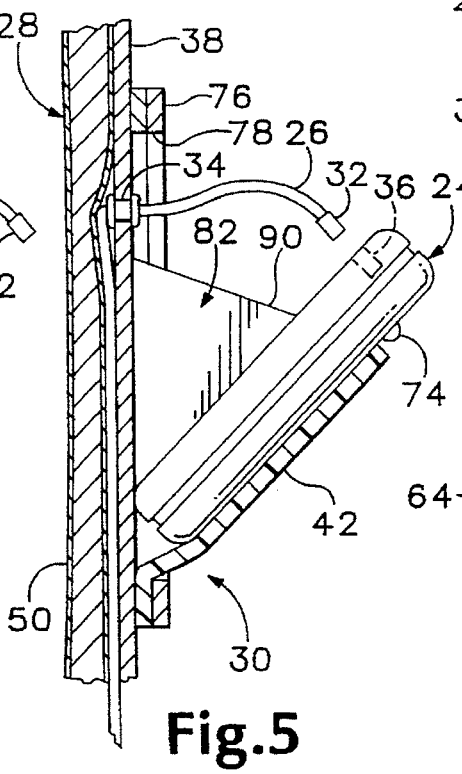

FIG. 1 shows an exemplary foot-warming device 20 for a boot that is constructed in accordance with the present invention. As depicted, the device includes a heating element 22, a battery pack 24 and an electrical cord 26 electrically connecting the heating element and the battery pack. The exemplary foot-warming device also includes an insulative liner 28 and an exemplary support assembly 30. Referring also to FIGS. 4–5, after the heating element and electrical cord have been installed within the liner, preferably in the manner described below, the liner is inserted inside the boot, and a connector 32 on one end of the electrical cord is passed through an opening 34 formed in the shoe for electrical connection to a power terminal 36 on the battery pack. The battery pack is then mounted by the support assembly 30 in a predetermined position 40 with respect to the upper surface 38 of the boot as shown in FIG. 2.

Figure 3:
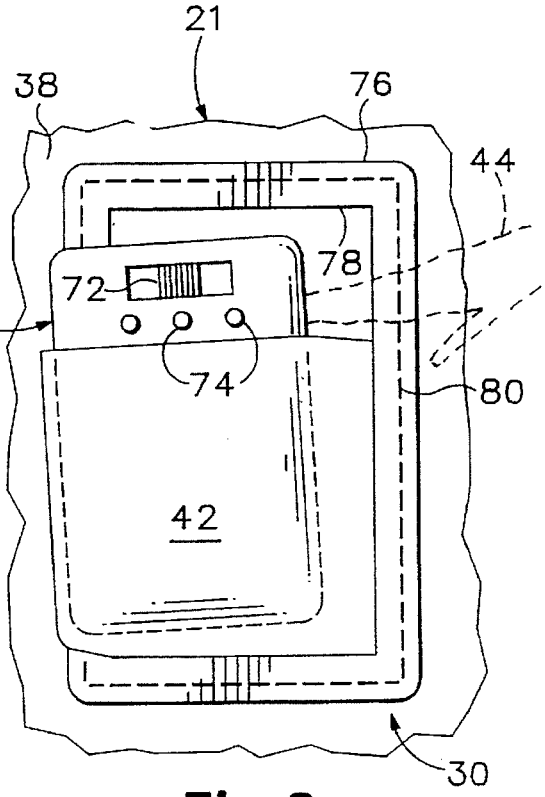
FIG. 3 is a view similar to FIG. 2 further showing how the support assembly yields so as to enable the battery pack to move away from its predetermined support position when impact occurs between the battery pack and an external object, which external object is shown in phantom-line view.
Figure 6:
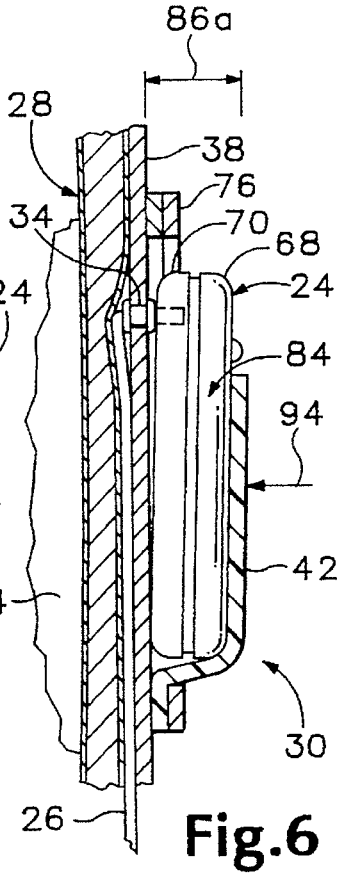
Figure 7:
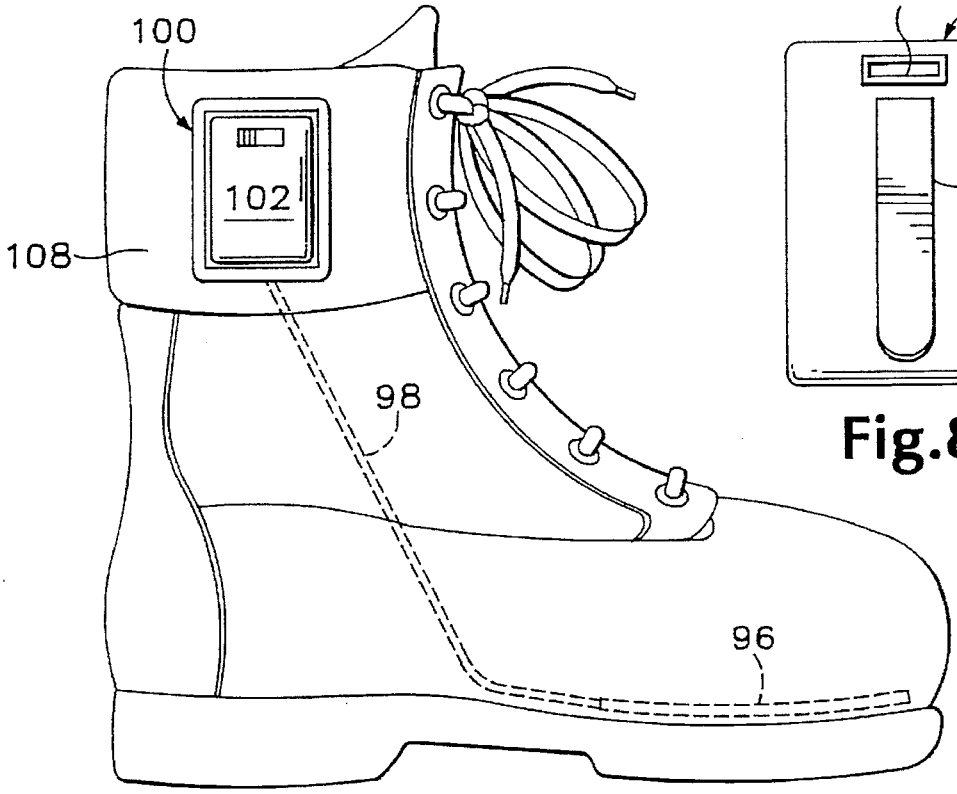
FIG. 7 is a side elevational view of an alternative embodiment of the foot-warming device.
Figure 8:
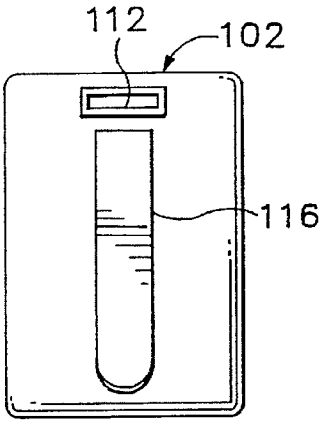
FIG. 8 is a plan view of the back side of the battery pack for the foot-warming device shown in FIG. 7.
Figure 9:
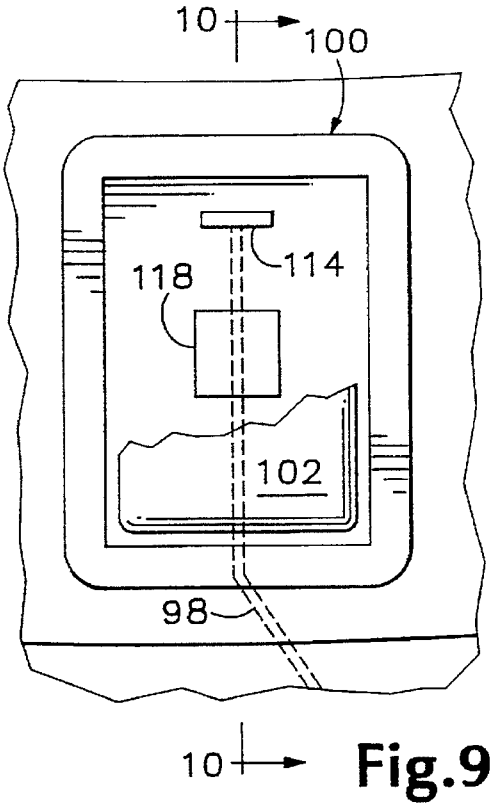
FIG. 9 is a plan view of a broken-away portion of the upper collar of the boot of FIG. 7 where the upper portion of the battery pack has been broken away to reveal details of the support assembly.
Figure 10:
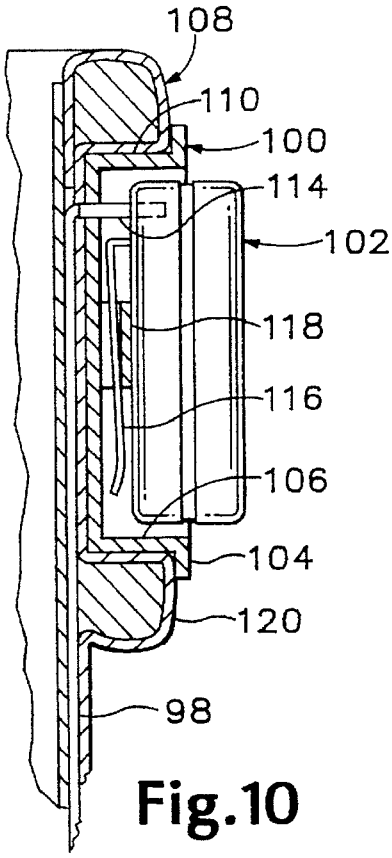
FIG. 10 is primarily a sectional view taken along line 10—10 of FIG. 9.

In accordance with its preferred construction, the support assembly includes a stretchable outer covering 42. This outer covering, in the preferred embodiment shown in the drawings, is formed of neoprene and, as shown in FIGS. 5–6, is so configured that it can stretch to form a pocket of suitable dimensions for receiving the battery pack. In accordance with this construction, if impact should occur between, on the one hand, the boot or battery pack and, on the other hand, an immovable external object (such as object 44 in FIG. 3), then the peak level of shock force imparted to the battery pack during the impact will be reduced as the neoprene material yieldably stretches in a manner that allows the battery pack to move away from its predetermined support position 40.

Later on, when the time comes to remove the foot-warming device 20, the battery pack 24 is easily removed from the neoprene pocket without special tools or complicated manipulations. As shown in FIG. 4, removal of the battery pack causes the neoprene covering 42 to return to a flattened position against the upper surface 38 of the boot, thereby minimizing the profile of the support assembly 30 relative to the upper surface. The connector 32 of the electrical cord is then passed back through the opening 34 in the boot and, preferably in conjunction with the heating element 22, is removed from the boot, which removal can occur either with or without the insulative liner 28. Thus no exposed conductive surfaces are left on the boot to tarnish or corrode when the battery pack is not in use. From this broad overview of the operation of the exemplary foot-warming device 20, at least certain of the significant advantages of the device will be readily apparent. A more detailed discussion of the specific components of the device is provided hereinbelow.

Referring to FIG. 1, the insulative liner 28 of the exemplary foot-warming device 20 generally conforms in shape to the inside surface of the boot and includes a neck portion 46 extending above the collar portion 48 of the boot. Referring also to FIG. 4, the insulative liner is of quilted construction and includes a soft, comfortable inside layer 50, such as of CAMBRELLE™ material, a durable outside layer 52, such as of nylon-based NYLEX™ material, and an insulative intermediate layer 54, such as of polyester fiber or cotton batting. Suitably sized to removably fit inside the bottom of the liner is a molded insole 56. Formed along the upper toe portion of this insole is a cavity 58. The heating element 22, which can be of elliptical shape for example, is press-fitted into this cavity in order to facilitate later removal of the element for easy repair. This heating element, which is of a construction well known to those of ordinary skill in the art, includes a conductive strip of serpentine configuration that is bonded between a pair of MYLAR™ sheets.

Formed in the bottom side of the molded insole 56 is a narrow channel 60 which snugly receives the electrical cord 26. One end 62 of the electrical cord is connected electrically to the heating element 22. Starting from the region of the heating element, the electrical cord 26 extends along the channel in approximate alignment with the longitudinal centerline of the insole until the beginning of the heel portion is reached. At this point, the channel and cord diverge off to one side, and the cord emerges from under the insole and is immediately passed through a slit or buttonhole (not shown) that is formed in the insulative liner 28. Referring to FIGS. 4–6, the electrical cord is then run vertically between the outside layer 52 of the liner and the upper surface 38 of the boot. This protects the ankle portion 66 of the user's foot against possible discomfort since the electrical cord cannot be felt through the padded layer provided by the liner. The second end of the electrical cord which carries the connector 32 is passed through the upper surface of the boot through the opening 34 formed in the upper surface, which opening, as shown, can be reinforced by a nylon or polypropylene grommet 66. As indicated in FIGS. 4–5, a small length of electrical cord can be drawn through the opening in order to facilitate attachment of the connector to the power terminal.

From the foregoing description, it will be readily apparent that the heating element 22 and electrical cord 26 can be fully removed from the boot by lifting the insole 56 out of the liner 28 while, at the same time, running the electrical cord back through the opening 34 formed in the boot and back through the slit formed in the liner. This facilitates convenient repair of these electrical components and, during the warmer seasons of the year, enables removal of these components so as to minimize the weight of the boot when the device is not in use. As will also be apparent, when the battery pack 24 is not in use, the connector 32 of the electrical cord can be drawn back through the opening 34 to a nonexposed or concealed position removed from such opening with or without full removal of the insole and electrical cord from the boot. This ensures that the conductive portions of the electrical cord are not exposed to corrosive agents when the battery pack is off the boot, which exposure would otherwise gradually degrade the transmission characteristics of the electrical connection between the heating element and the battery pack. In accordance with this procedure, then, the maximum heat-producing capacity of the foot-warming device is able to be maintained at a steady level throughout the life of the device. It may also be noted that the liner 28 contributes to the efficiency of the foot-warming device by concentrating the heat produced by the heating element 22.

Referring now to FIGS. 2 and 6, when the battery pack 24 is in use and is being supported by the support assembly 30, the opening 34 for the connector 32 is so arranged relative to the battery pack that the connector is covered by the battery pack. Accordingly, whether the battery pack is on or off the boot, the conductive portions of the electrical system can be protected against exposure. Moreover, because there are no lengths of loose cord running along the upper surface of the boot, there is no risk of the cord being snagged and damaged by objects on the ground during use of the device.

Referring again to FIGS. 2 and 6, the battery pack 24 of the exemplary device 20 includes an outer casing made of high-impact plastic. This casing can be forced open into separate front and back sides 68 and 70 so as to facilitate battery replacement. On the front face of the battery pack, a three-way slide switch 72 is provided that enables the battery pack to be switched between low-power, off, and high-power control positions, respectively, and corresponding indicators lights (e.g. light-emitting diodes) are provided to indicate which control position has been activated. Although not shown, the indicator lights are labeled with appropriate symbols, such as "LOW", "OFF" and "HI.". The conductive power terminal 36 of the battery pack is located on the back side of the casing and is suitably dimensioned for mating engagement with the connector 32 of the power cord. If desired, other connection sites can be provided on the battery pack so as to enable, for example, recharging of the battery pack from a standard wall outlet using a conventional AC-to-DC conversion device.

Referring to FIG. 2, the exemplary support assembly 30 of the foot-warming device 20 includes a stretchable outer covering 42 and a retaining member 76. In the preferred embodiment shown in the drawings, the retaining member is constructed from a thin leather sheet and is provided with a frame-like shape so as to include a shallow inner shoulder 78. This retaining member together with a panel-shaped piece of the stretchable outer covering are secured, as by stitching 80, to the sheet-like material that forms the upper surface 38 of the boot. Preferably this is done in such a manner that the edges of the outer covering are firmly secured on two or more sides beneath the retaining member. As mentioned above, in the exemplary foot-warming device that is shown, the stretchable outer covering 42 is formed of neoprene. If another type of stretchable material is employed, preferably this alternative material possesses characteristics comparable to that of neoprene in terms of durability, yielding ability and cushioning ability.

In accordance with the above-described construction of the exemplary support assembly 30, the battery pack 24 can be easily and quickly attached to the support assembly without the need, for example, for complicated manipulations of any components on the assembly or any special tools. As indicated in FIGS. 4–6, in order to attach the battery pack to the support assembly, the neoprene covering or panel 42 is merely stretched open to form an expanded pocket 82 and the battery pack is tiltably inserted into this pocket so as to provide sufficient space for conveniently attaching the connector 32 to the power terminal 36. The extra length of the electrical cord is then drawn back through the opening 34 and the battery pack is allowed to pivot so that its back side 70 comes to rest directly against the upper surface 38 of the boot in the manner depicted in FIG. 6. As the battery pack pivots to a settled position, the neoprene covering 42 draws back to form a contracted pocket 84 that Conforms closely in shape to the low contour of the battery pack.

By reversing the procedure just described, the battery pack-can be quickly detached from the support assembly, again without any complicated manipulations or special tools. Nor in detaching the battery pack is it necessary to remove any small or easily lost parts, such, as tiny screws. From the foregoing description, then, it will be recognized that those portions of the foot-warming device 20 most likely to need attention or repair, namely the heating element 22, electrical cord 26, and battery pack 24, are each easily removable in a convenient manner from the boot.

In conjunction with the retaining member 76, the stretchable covering 42 supports the battery pack 24 in such a manner that the position of the battery pack is prevented from migrating over the upper surface 38 of the boot. More specifically, referring to FIGS. 2 and 6, the inner shoulder 78 of the retaining member 76 forms a shallow barrier or depression on the upper surface 38 of the boot that closely borders the battery pack. Thus the battery pack is normally confined to a predetermined support position or area 40 fixed in relationship to the upper surface unless, that is, a strong shock force is felt by the battery pack sufficient to cause the battery pack to jump the shallow barrier. Even when such a force is felt, however, the neoprene covering 42 acts like an automatic return mechanism that, in response to movement by the battery pack away from the predetermined support position, resiliently urges the battery pack back toward this position. In short, then, the support assembly is able to support the battery pack so as to eliminate the need for repeated and bothersome adjustment of the battery pack's position during use of the foot-warming device.

A further advantageous feature of the exemplary support assembly 30 is that it supports the battery pack 24 in such a manner that the battery pack does not excessively protrude above the upper surface 38 of the boot. This, in turn, reduces the probability of direct impact occurring between the battery pack and external objects on the ground. Referring to FIG. 6, it will be recognized that because the upper surface 38 forms the bottom of the pocket 84 that supports the battery pack, the battery pack rests directly against the upper surface and there is no intervening member to add to the distance by which the battery pack projects above the upper surface. As FIG. 6 also shows, the stretchable neoprene covering forms a thin, taut layer over the front face of the battery pack and keeps the battery pack in a position closely hugging the upper surface. It may be noted that even with the battery pack resting in this manner directly against the upper surface, the battery pack will not be felt by the adjacent portion 66 of the user's foot , since the insulative liner 28 serves to cushion or pad the foot in the region directly underlying the battery pack.

Referring to FIGS. 4 and 6 together, it will be recognized that when the battery pack 24 is removed from the support assembly 30, the distance by which the support assembly protrudes above the upper surface 38 will shift from a first elevation 86a to a relatively lower second elevation 86b as the neoprene covering or panel 42 retracts to a position flat against the upper surface. In effect, the support assembly includes a self-adjusting height-limiting mechanism that operates so as to further minimize the probability of direct impact occurring between attached structures on the boot and external objects. Referring particularly to FIG. 4, it will be recognized that when the neoprene covering retracts to a position flat against the upper surface, the mouth 90 of the pocket that is formed by the neoprene covering is closed shut, which action desirably prevents the accumulation of moisture and debris inside the pocket when the battery pack is not in use.

An important feature of the exemplary foot-warming device 20 is its ability to protect the foot and battery pack against a severe jolt. As noted hereinabove, rather than rigidly supporting the battery pack, the exemplary support assembly 30 yieldably supports the battery pack. If, for example, a direct impact occurs between the battery pack 24 and an immovable external object 44, such as in the manner indicated in FIG. 3, the neoprene covering 42 is able to stretchably yield so as to enable the battery pack to move at least temporarily away from the point of impact (i.e., its predetermined support position). Accordingly, the level of shock forces that are transmitted during this type of impact are reduced. By way of comparison, if the battery pack were rigidly mounted on the boot when such an impact occurred, substantially larger shock forces would be transmitted during a considerably shorter period of time as would tend to cause the battery pack to bounce back from the object in such a manner as to stun the foot. It will further be recognized that the exemplary support assembly 30 not only protects the battery pack during direct impacts but also protects it during indirect impacts. If, for example, the user were to accidently slam the toe of his boot against a large rock, the neoprene covering 42 would stretchably yield so as to permit the battery pack to move toward the point of impact.

Yet another type of impact that can occur involves a sweeping or thrusting force that tends to push the battery pack 24 back against the boot 21. This type of impact would occur, for example, if the branches of a shrub were to bendably brush against the neoprene covering 42. Referring to FIG. 6, the opposing faces 92*a* and 92*b* of the neoprene covering are able to resiliently respond to any force, such as force 94, acting generally perpendicular to these faces, and hence is able to cushionably protect the covered portions of the battery pack against sweeping or thrusting forces of this type. Although the risk of severe jolts from such forces is not particularly great since these forces act perpendicular to the primary direction of boot travel such forces are able to mar the finish of the battery pack so as to make the system visually less attractive. In this respect, then, the elastomeric neoprene panel that forms the outer covering of the exemplary support assembly 30 is superior in its cushioning attributes to other possible forms of yieldable covers, such as open-mesh fabric made of stretchable cord.

Referring to FIGS. 7–10, an alternative embodiment of the foot-warming device is illustrated. This alternative embodiment includes a heating element 96, an electrical cord 98, a support assembly 100, and a battery pack 102. In this alternative embodiment, the support assembly consists of a rigid bracket made of high-impact plastic, which bracket has a wide upper margin 104 and a recessed portion 106. This bracket is adhesively fastened to a padded collar 108 formed on the boot so that the recessed portion forms a depression 110 in the padded collar. The battery pack includes a power terminal 112 which detachably engages the connector 114 of the electrical cord, and the battery pack further includes a clip 116 that is inserted through a retaining ring 118 provided within the recessed portion of the rigid bracket so as to cause the battery pack to project at least partially into the depression 110 formed by the bracket. In comparison to the exemplary embodiment of the foot-warming device 20 shown in FIGS. 1–6, the alternative embodiment shown in FIGS. 7–10 allows the battery pack to ride somewhat lower relative to the immediately surrounding upper surface 120 of the boot. This advantage, however, is offset to some degree by the inability of the rigid bracket 100 to yieldably support the battery pack so as to protect the foot and the battery pack against a severe jolt.

From the foregoing description, it will be recognized that alternative embodiments of the present invention are possible without departing from the broader principles of the invention. For example, it is possible to redesign the exemplary foot-warming device so as to eliminate the liner or the separate insole or, alternatively, the liner, the insole and the heating device could be combined together to form an integrated assembly. Also, it is possible to adapt the foot-warming device to a wide variety of boot styles including, for example, boots having rigid uppers instead of uppers formed of semipliable sheet-like material. Furthermore, various configurations and materials can be used in the design of the support assembly, although it is preferable to use commonly available materials in order to minimize production costs. Moreover, further integration of components is possible with respect to the boot and support assembly.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A foot-warming device in combination with an article of conventional footwear, said footwear having an upper surface, said device comprising:

(a) a heating element able to be positioned inside said footwear so as to leave sufficient space inside said footwear for the foot of a user;

(b) an electrical cord assembly connected electrically, at one end, to said heating element and including, at the other end, a connector;

(c) a battery pack including a power terminal detachably connectable electrically to said connector for providing power to said heating element; and (d) a support assembly able to detachably support yieldably said battery pack along said upper surface of said footwear so as to enable said battery pack to move relative to a predetermined support position fixed in relation to said upper surface in response to impact between said battery pack and external objects, said support assembly including an outer covering fastened to said upper surface so as to lie flat against said upper surface, said outer covering being constructed so as to elastically stretch to selectively receive said battery pack therebeneath and to thereby support said battery pack in said predetermined support position, said outer covering providing an automatic return mechanism such that, in response to any movement by said battery pack away from said predetermined support position, said outer covering urges said battery pack back toward said predetermined support position.

2. The foot-warming device of claim 1 wherein said battery pack is supportable by said support assembly so that said battery pack rests directly against said upper surface.

3. The foot-warming device of claim 1 wherein said electrical cord assembly is fully removable from said footwear.

4. The foot-warming device of claim 1 wherein said heating device is fully removable from said footwear.

5. The foot-warming device of claim 1 further including a padded liner removably inserted into said footwear and arranged to that said battery pack cannot be felt through said upper surface by the side of said foot.

6. A foot-warming device in combination with an article of conventional footwear, said footwear having an upper surface, said device comprising:

(a) a heating element able to be positioned inside said footwear so as to leave sufficient space inside said footwear for the foot of a user;

(b) an electrical cord assembly connected electrically, at one end, to said heating element and including, at the other end, a connector;

(c) a battery pack including a power terminal detachably connectable electrically to said connector for providing power to said heating element; and (d) a support assembly able to detachably support said battery pack along said upper surface of said footwear, said support assembly including a pocket that opens toward the top of said footwear for receiving said battery pack, said pocket being formed, at least in part, by a flexible outer covering permanently fastened to said upper surface, said pocket being sized so as to hold only a portion of said battery pack when said battery pack is fully inserted into said pocket.

7. The foot-warming device of claim 6 wherein said support assembly includes a retaining member having an inner shoulder, said retaining member being attached to said upper surface about said outer covering so that said pocket opens toward an immovable portion of said inner shoulder and is spaced apart from said immovable portion of said inner shoulder.

8. The foot-warming device of claim 6 wherein said outer covering is made of elastically stretchable material.

9. The foot-warming device of claim 6 wherein said outer covering automatically retracts to a position flat against said upper surface when said battery pack is removed from said pocket.

10. The foot-warming device of claim 6 wherein said battery pack rests directly against said upper surface when fully inserted into said pocket.

* * * * *